US006065516A

United States Patent [19]

Chang

[11] Patent Number: 6,065,516

[45] Date of Patent: May 23, 2000

[54] PROTECTIVE HEAD SHEATH FOR GOLF CLUB

[75] Inventor: Chen-Te Chang, Taichung Hsien, Taiwan

[73] Assignee: Minghung Plastic Industry Co., Ltd., Taichung Hsien, Taiwan

[21] Appl. No.: 09/192,363

[22] Filed: Nov. 16, 1998

[51] Int. Cl.[7] ..... A63B 57/00

[52] U.S. Cl. ..... 150/160; 206/315.4

[58] Field of Search ..... 150/159, 160; 206/315.2, 315.4

[56] References Cited

U.S. PATENT DOCUMENTS

| | | | |
|---|---|---|---|
| 3,051,210 | 8/1962 | Mesinger | 150/160 |
| 3,478,799 | 11/1969 | Hoyt, Jr. | 150/160 |
| 4,971,126 | 11/1990 | Borenstein | 150/160 |
| 5,117,884 | 6/1992 | Diener et al. | 206/315.4 X |
| 5,415,213 | 5/1995 | Diener et al. | 150/160 |
| 5,575,720 | 11/1996 | Daniel | 206/315.2 X |
| 5,611,379 | 3/1997 | Hoyt et al. | 150/160 |
| 5,615,720 | 4/1997 | O'Sullivan | 150/160 |
| 5,735,327 | 4/1998 | Aldcroft et al. | 150/160 |
| 5,941,293 | 8/1999 | Serpa | 150/160 |

FOREIGN PATENT DOCUMENTS

| | | | |
|---|---|---|---|
| 1360058 | 7/1974 | United Kingdom | 206/315.2 |

*Primary Examiner*—Sue A. Weaver
*Attorney, Agent, or Firm*—Bacon & Thomas, PLLC

[57] ABSTRACT

An integrally molded head sheath for golf club made of soft and elastic material comprises a head-collaring portion in shape of a club head and a sleeve-collaring portion in shape of a long pipe with a downward opening. An elastomer is disposed near the opening end of the sleeve-collaring portion, and an insertion space is formed therein and having an inner diameter coincident with a neck sleeve of a club head. A relatively smaller entrance and two outward expanded guide strips are provided at the sleeve-collaring portion. The two guide strips of the elastomer are extended from the bottom end of the sleeve-collaring portion to a location near the lower end of the head-collaring portion to form an outward collaring mouth. A plurality of protrusion dots are disposed at the inner edge of the head-collaring portion to enable the sheath to collar onto the club head easily for protection.

2 Claims, 9 Drawing Sheets

PROTECTIVE HEAD SHEATH FOR GOLF CLUB

BACKGROUND OF THE INVENTION

The invention relates to a golf club, and particularly to a protective head sheath for golf club.

Golf sport, a relatively milder sport offering physical activity in virtue of relaxation, is gradually prevailed all over the world, especially in the recent decade. Most part of the lately joined golf population is attributable to the white-collar workers who could not but now can afford to pay the course charges. Other than the popularized charges, an inducing factor supporting the fascinating sport may be considered in its variability in course topography, wind direction, hitting distance, and selection of a right club, etc.

For the sake of convenience, a bag filled with different golf clubs is carried along with a player all the way in a course no matter where he goes. A player is more or less annoyed with the disordered clubs at a sum from 12 to 14 pieces in his golf bag that he has to guess a right one occasionally, and besides, the club heads may be scraped due to inter-collisions en route from one green to another. Therefore, a partition concept has been introduced to align and isolate the clubs in order, however, after some period of time, a player may find out that the clubs in his golf bag are again in a mess again because of his indolence to reset each club after use to its original position. Every time when a player decides to rearrange his golf clubs, the club heads thereof may collide against one another and get scraped again.

Various means have been considered to eliminate the above-described defects, wherein, as shown in FIG. 1, a protective head sheath is proposed based on the contour of a club head shown in FIG. 3. A slit is designed laterally at a lower side as an entrance for collaring the upper end of a club head. This structure has the following disadvantages:

1. A troublesome attachments procedure—to pull the slit of the head sheath to open wider for collaring onto top end of the club head in a proper direction, then adjust the angle to swallow the entire head;
2. A higher fabrication cost—after blow molding of the head sheath, processing a slit on a golf bag requires extra manpower.

Another known head sheath is shown in FIG. 2, wherein a wider opening is made to facilitate easy collaring onto a club head. However, owing to lack of fitness, the covered head sheath cannot envelop the club head steadily and may sometimes slip off. Thus, an elastic metallic clamp has been introduced for clamping at the head sleeve but, the head sleeve is liable to be scraped by the fixing clamp, and extra manpower is required to perforate at least two holes for installation of the metallic clamp. In addition, the bulky and slack head sheath is unattractive.

In view of the above, the present inventor provides an improved protective head sheath for a golf club.

SUMMARY OF THE INVENTION

This invention means to mainly provide a protective head sheath for golf club, wherein the head sheath comprises an elastomer provided nearby a neck sleeve; an internal insertion space formed in an inner diameter commensurate with a club body to be enclosed; a relatively smaller entrance and two outward expanded guide strips disposed in the head sheath for easy collaring and keeping on a club head.

Another object of this invention is to provide an integrally molded protective head sheath made of soft elastic material, which can collar easily onto a club head in virtue of a trumpet-shaped opening for protective purpose.

A further object of this invention is to provide a protective head sheath that is integrally molded to eliminate extra processing work for lowering down fabrication cost.

The embodied skill for achieving the foregoing purposes includes:

a protective head sheath consisting of a head-collaring portion in the same shape with a club head and sleeve-collaring portion with a downward opening in a long pipe shape;

an integrally molded protective head sheath made of soft elastic material, comprising: an elastomer disposed nearby the sleeve-collaring portion, a insertion space available therein in an inner diameter commensurate with head sleeve, a relatively smaller entrance, and two expanded outward guide strips that have been extended from bottom end of the sleeve-collaring portion to lower end of the head-collaring portion at a decent location to form an outward collaring mouth.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
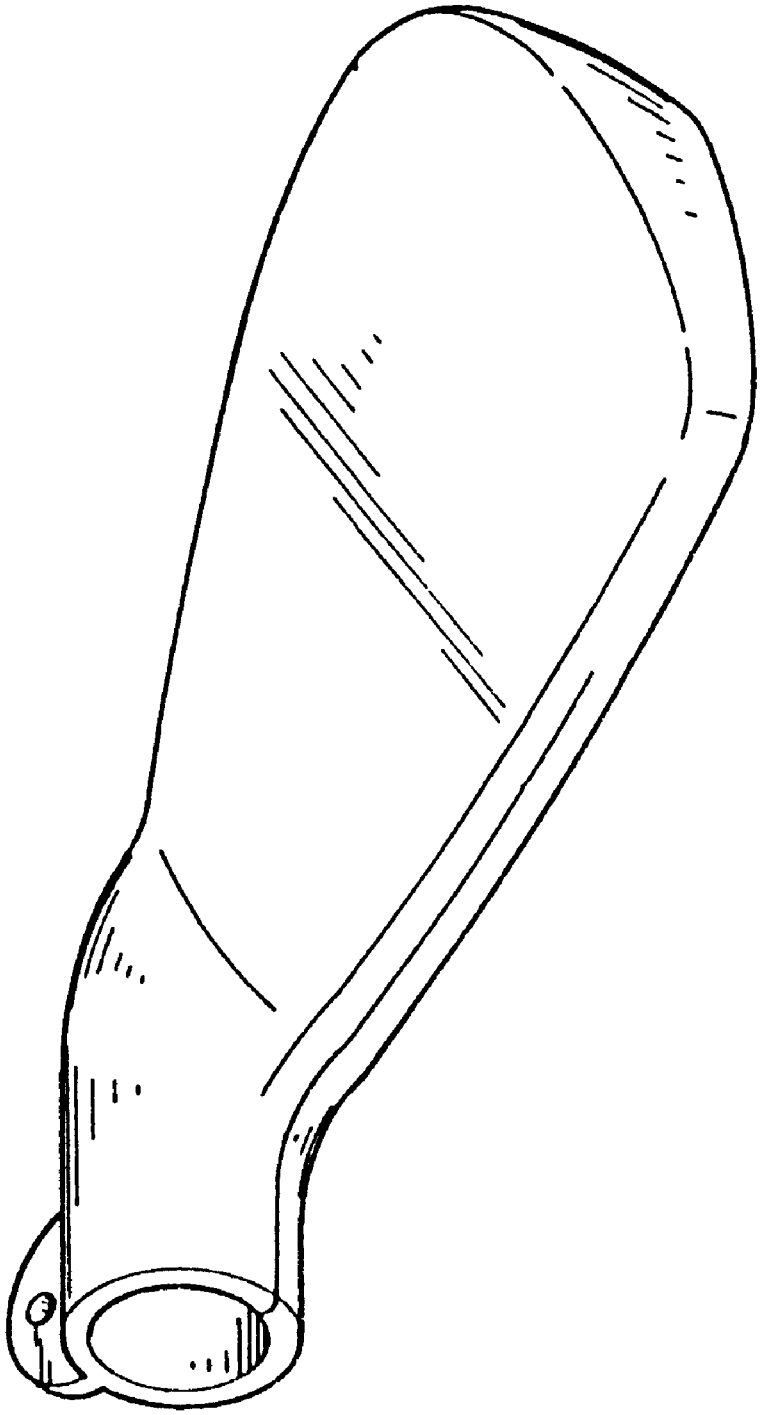
Fig·1 PRIOR ART
FIG. 1 is a perspective view of a conventional head sheath.
Figure 2:
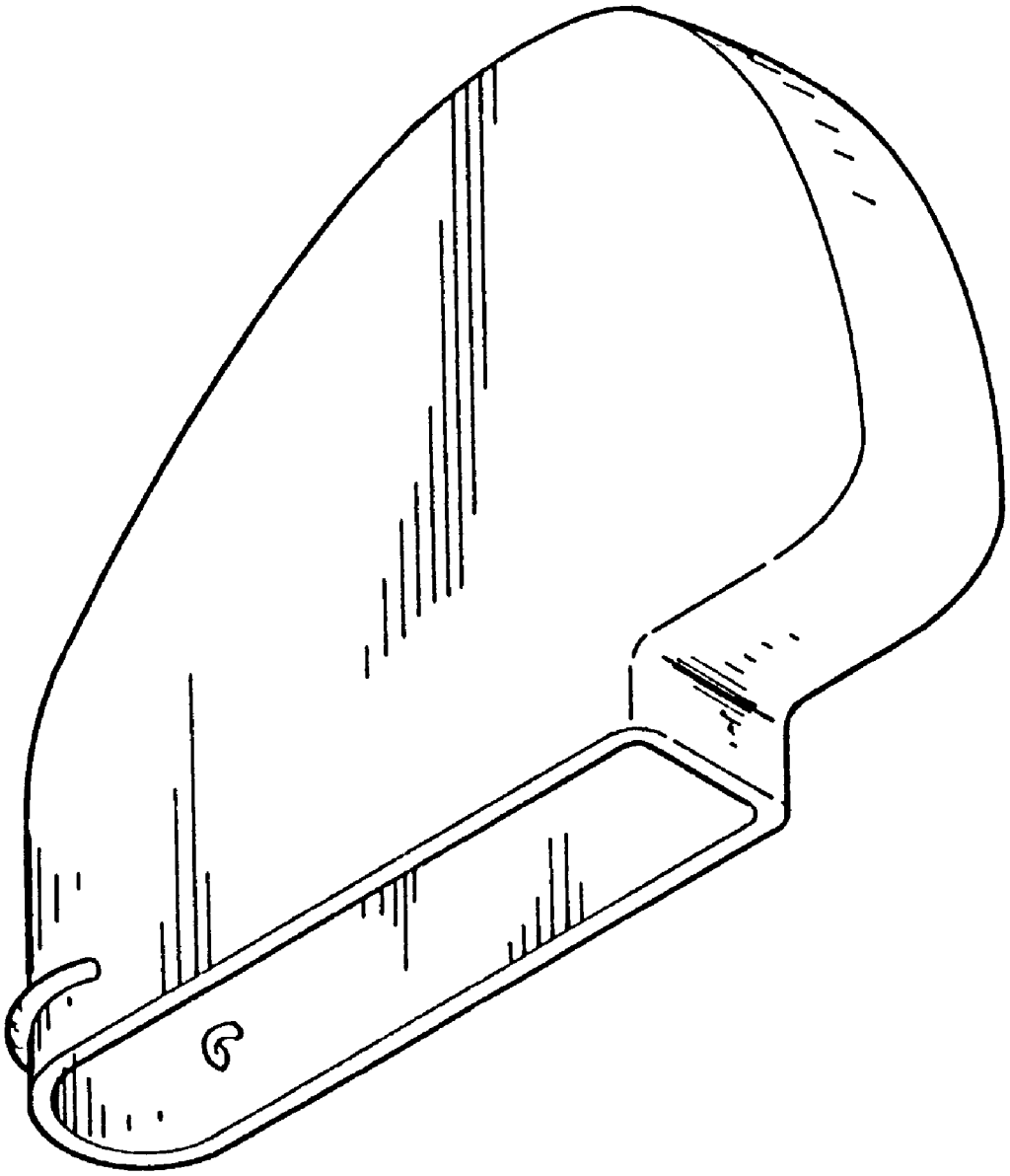
Fig·2 PRIOR ART
FIG. 2 is a perspective view of another conventional head sheath.
Figure 3:
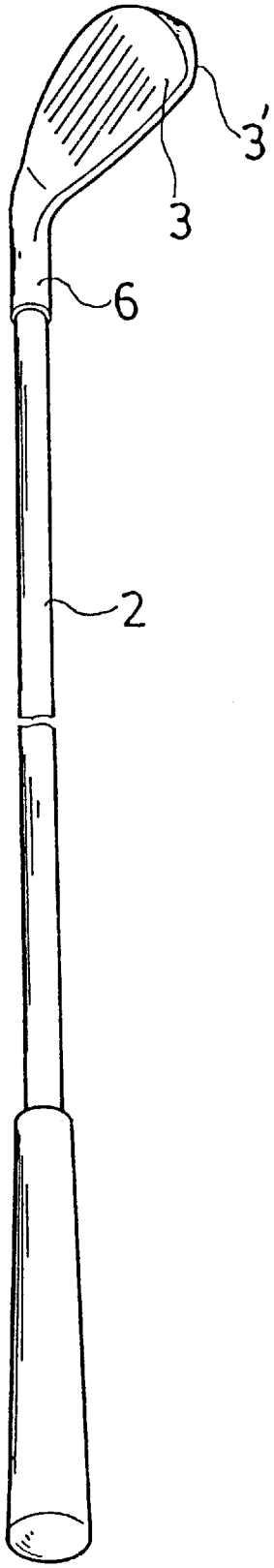
FIG. 3 is a perspective view of a golf club.
Figure 4:
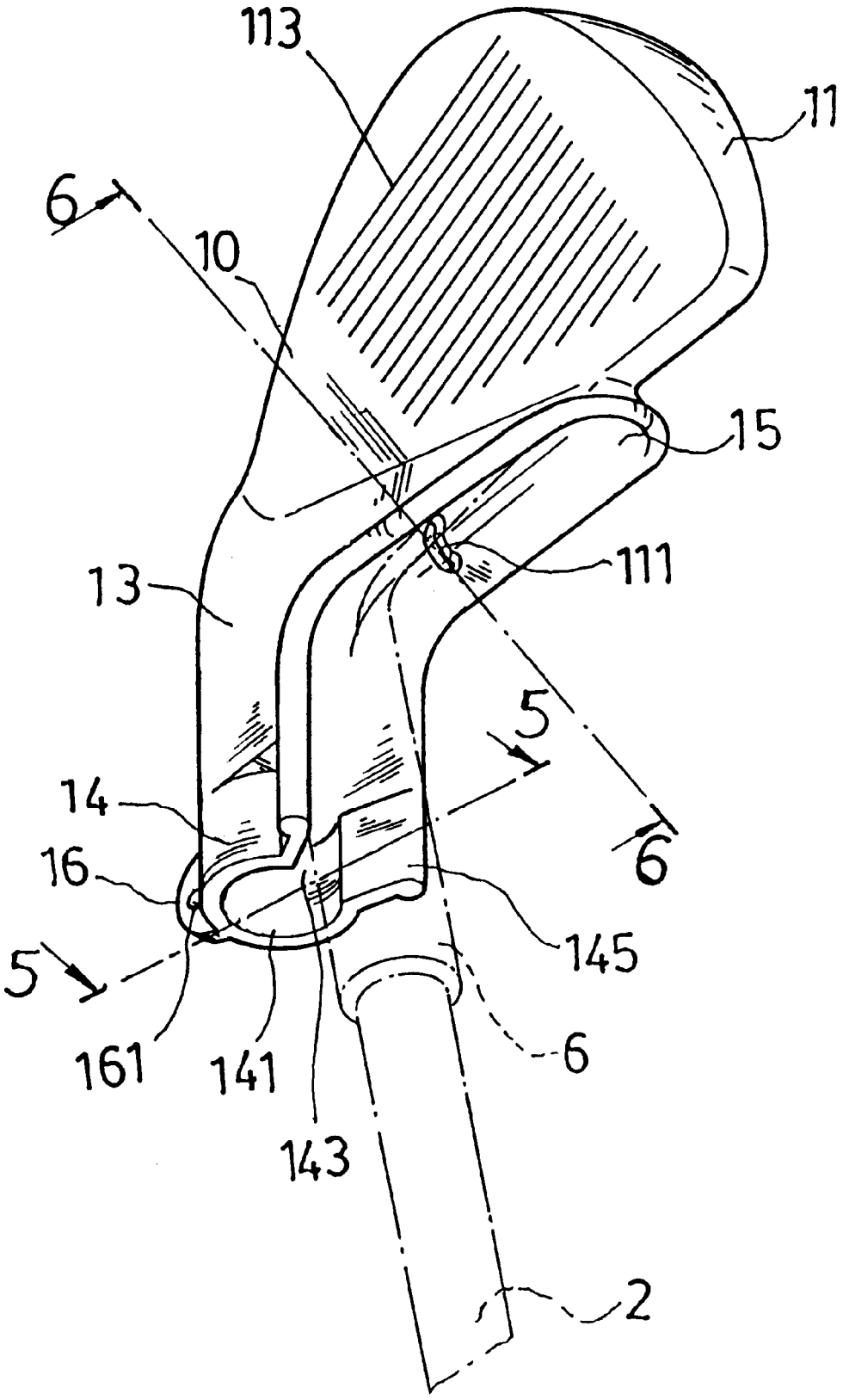
FIG. 4 is a perspective view of this invention.
Figures 5A, 5B:
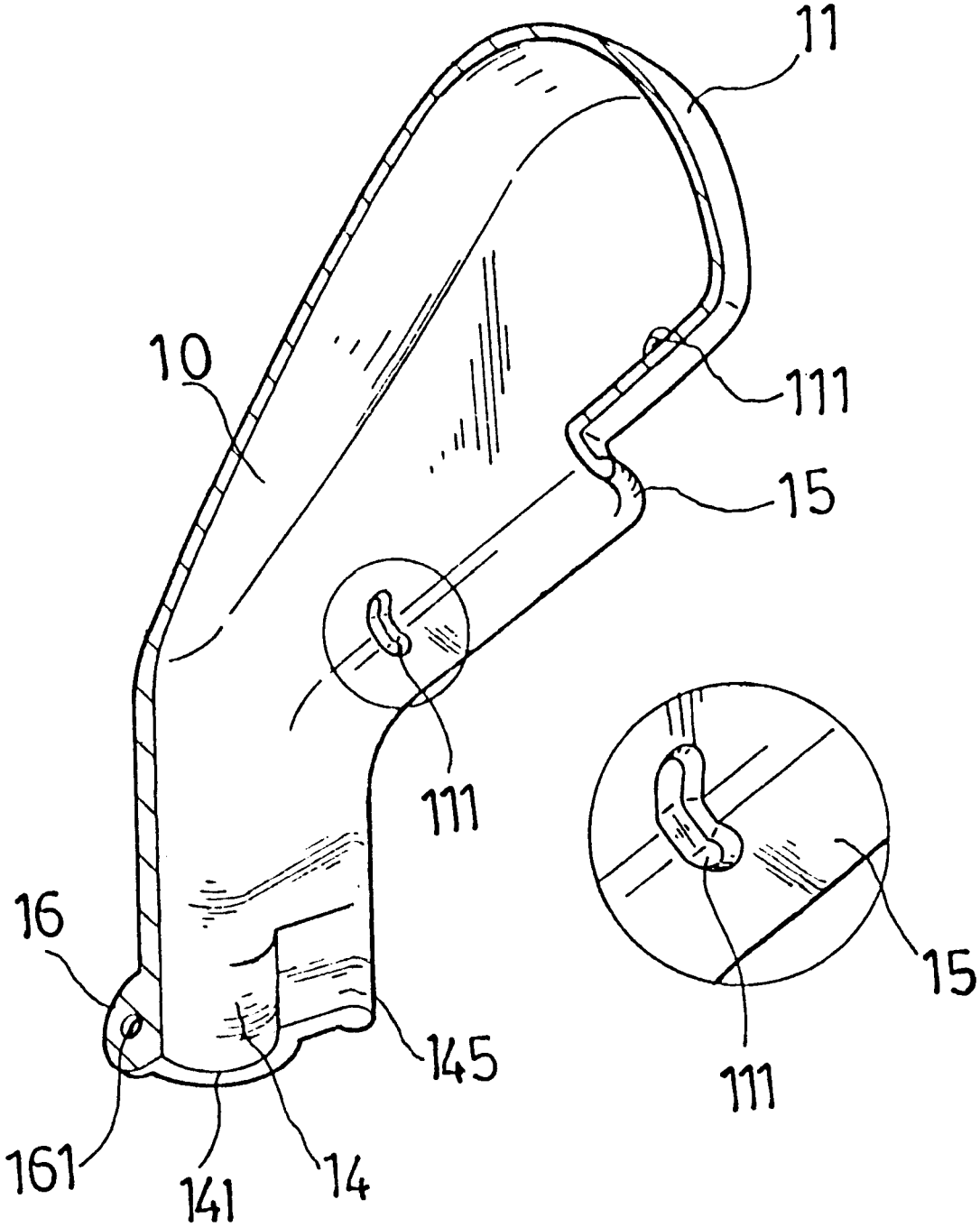
FIG. 5A is a cutaway sectional view of FIG. 4 along line 5—5.
FIG. 5B is a partially enlarged view according to FIG. 5A.
Figure 6:
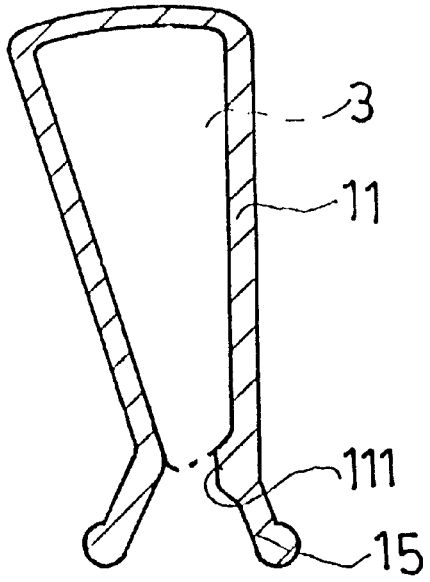
FIG. 6 is a cross sectional view of FIG. 4 along line 6—6.

As shown in FIG. 4 through FIG. 8, a protective head sheath for golf club of this invention is an integrally molded head sheath 10 made of soft, elastic material that includes a head-collaring portion 11 in the same shape as of a club head and a sleeve-collaring portion 13 in shape of a long pipe with a downward opening. A trumpet shaped elastomer portion 14 is provided near an opening end of the sleeve-collaring portion 13, wherein an insertion space 141 is provided and having an inner diameter commensurate with a constrained neck sleeve 6 in order to prevent the head sheath 10 from loosening and slipping off when the head sheath 10 is being removed from or collared onto the club head 3. The head sheath 10 further comprises a relatively smaller entrance 143 to avoid neck sleeve 6 of the club head 3 from removal therefrom, and two expanded outwardly flaring guide strips 145 for guiding the input of the neck sleeve 6. The guide strips 145 of the elastomer 14 is extended from the bottom end of the sleeve-collaring portion 13 to the lower end of the head-collaring portion 11 and terminating to form an outward collaring mouth 15 (As shown in FIG. 4). Two protrusion dots 111 disposed along the inner edge at right side of the head-collaring portion 11 (As in FIG. 5B) are provided to bear against the non-striking face 3' of the club head 3 (As shown in FIG. 3) and confine the lower edge of the club head 3 to rest on one protrusion dot 111 (As shown in FIG. 6). Provision of the protrusion dots 111 may be taken as a dual assurance to avoid the head sheath 10 from loosening to slip off when removing from or collaring onto a golf club 2 as well as from unnecessary collisions. The collaring mouth 15 is formed by extending from the bottom end of the sleeve-collaring portion 13 to the lower end of the head-collaring portion 11, and the width of the collaring mouth 15 is slightly wider than the thickness of the club head 3 at its upper end to facilitate an easy input of the club head 3 to the protective head sheath 10. Moreover, on the left outer face of the head-collaring portion 11, a plurality of transverse stripes 113 may be formed.

Figure 7:
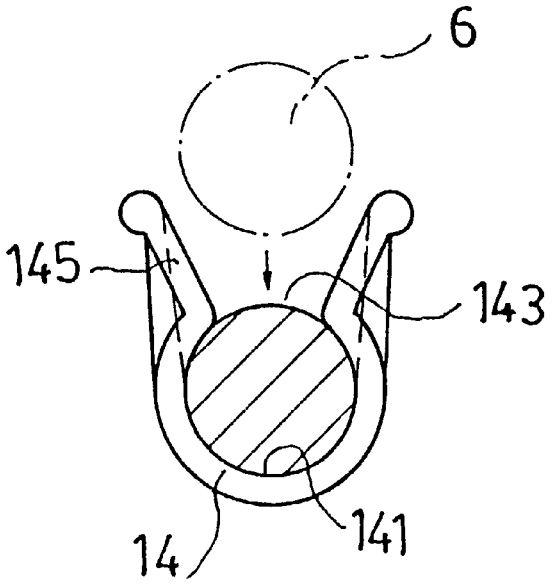
FIG. 7 is a schematic action diagram of this invention.

When collaring the protective head sheath 10 of this invention onto the club head 3, a player may hold at the head-collaring portion 11 to collar directly onto the top of the club head 3. And owing to soft and elastic characteristics of the integrally molded material of this invention, the collaring mouth 15 will open slightly to permit input of the club head 3 to the head-collaring portion 11 (As shown in FIG. 6). As described above, since the width of the collaring mouth 15 itself is slightly wider than the thickness of the club head 3, there would be no obstacle to clog the passage for the club head 3 to enter and get enclosed in the head-collaring portion 11. Then, the neck sleeve 6 will be pushed and guided by the guide strips 145 of the elastomer 14 to the entrance 143, which is already widened for reception of the neck sleeve 6 to enter the insertion space 141 of the elastomer 14, where the entrance 143 is enclosing on the head sleeve 6 (As shown in FIG. 7) to prevent the head sheath 10 from loosening to slip off when it is taken to collar onto or remove from the golf club 2. Meanwhile, retaining of the lower edge of the club head 3 at upper edge of the protrusion dots 111 of the head-collaring portion 11 provides a dual assurance and avoidance of inter-collisions of the club heads 3.

Figure 8:
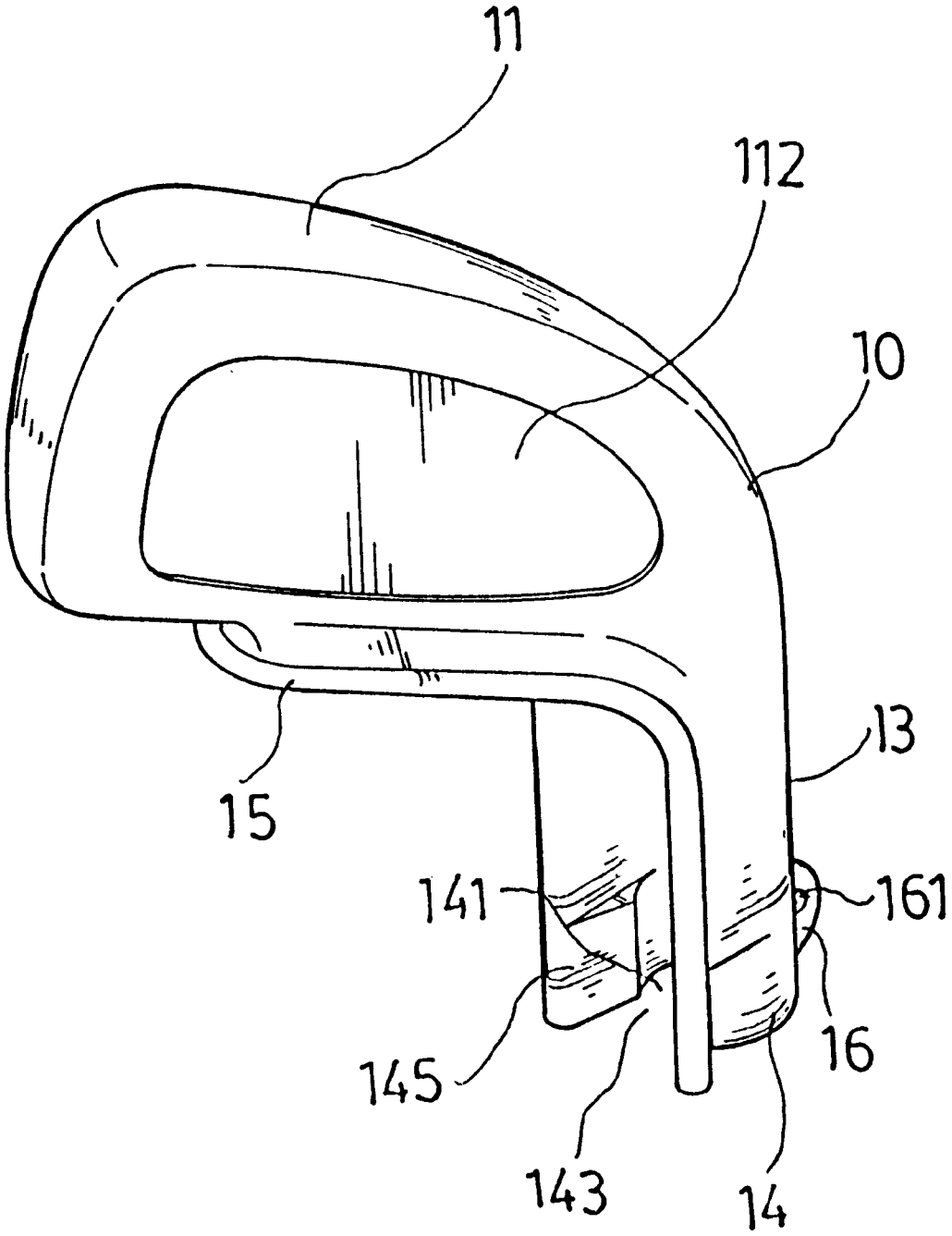
FIG. 8 is a schematic view showing an embodiment of this invention.

In addition, a slightly recessed concave portion 112 is formed at a right outer face of the head-collaring portion of this invention (As shown in FIG. 8), whereon a pattern may be placed for visage beautification or advertisement purpose, and also, a convex ear 16 with a through hole 161 is arranged laterally at the rim of the sleeve-collaring portion 13 for hanging a key ring to retain a removed head sheath 10.

Figure 9:
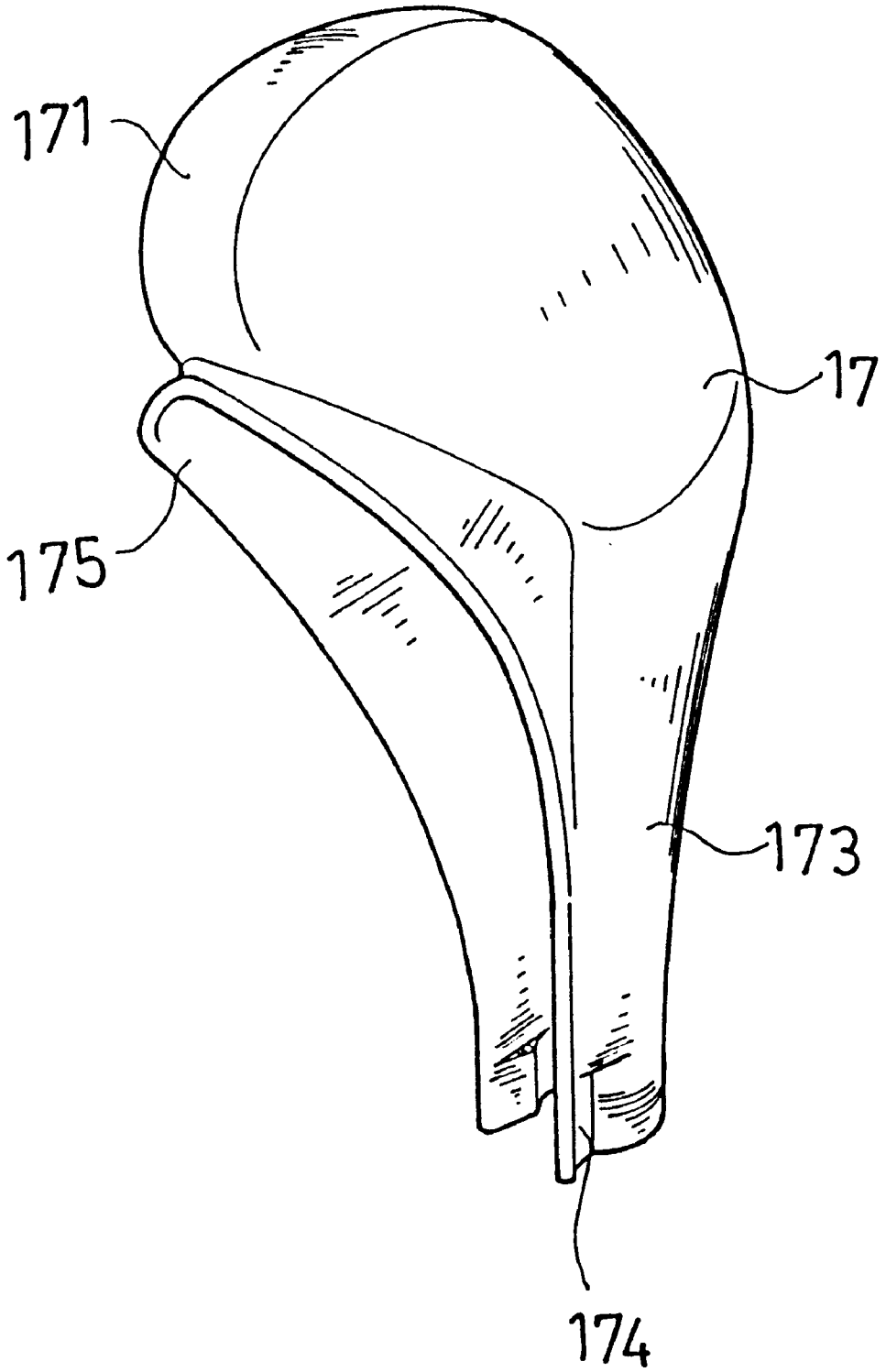
FIG. 9 is a schematic view showing another embodiment of this invention.
Figure 10:
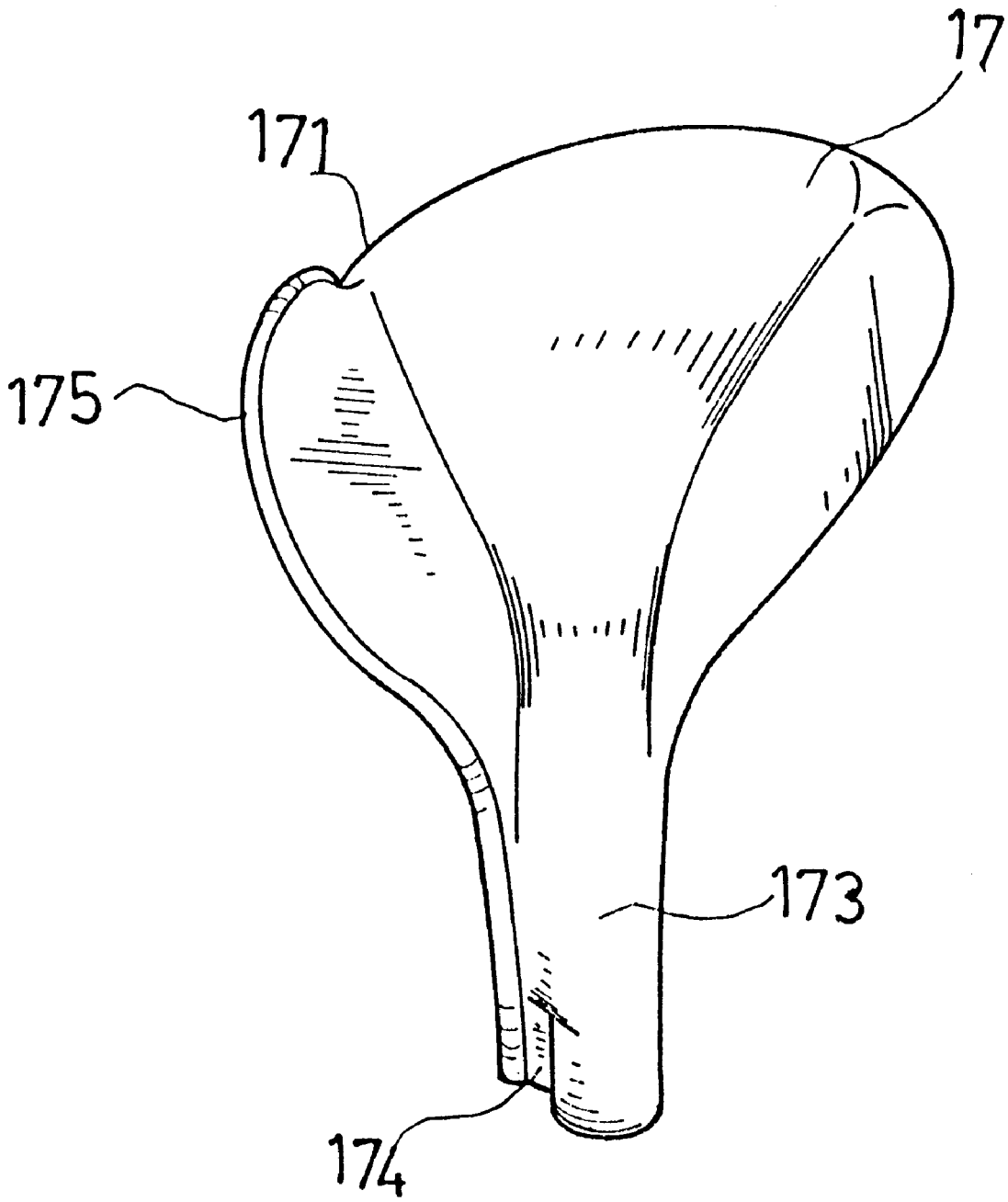
FIG. 10 is a schematic view of FIG. 9 from another visual angle.

Moreover, this invention may be formed in a shape as of head sheath 17 for application in a wooden club head shown in FIG. 9 and FIG. 10. This head sheath 17 also comprises main characteristic components such as, a head-collaring portion 171, a sleeve-collaring portion 173, an elastomer 174, and a collaring mouth 175, etc. The major difference to the foregoing embodiment is that those components in this case are disposed laterally for easy collaring of the head sheath 10 onto the wooden club head.

In summarizing the aforesaid, this invention will need no extra processing formalities by availing itself of an integrally molded soft and elastic material, which is instrumental to lower down fabrication cost. Further, disposition of the elastomer and the collaring mouth in this invention facilitates the head sheath to retain the head sleeve easily and can meanwhile prevent the head sheath from loosening or slipping off or inter-collision of the club heads when the head sheath is being removed from or collared onto the club head.

What is claimed is:

1. A protective head sheath for a golf club having a club head and a neck sleeve, the sheath being integrally molded of soft elastic material and comprising:

a) a head collaring portion for enclosing a club head and sleeve collaring portion for enclosing a neck sleeve of a golf club;

b) the head collaring portion being in the shape of a club head and including a lower end; and c) the sleeve collaring portion being in the shape of a long pipe and including a downward facing opening, an elastomer portion disposed adjacent the opening, an insertion space having an inner diameter corresponding to the neck sleeve, an entrance extending along a side of the insertion space, a pair of guide strips extending outwardly from opposite sides of the entrance and from a lower end of the sleeve collaring portion up to a lower end of the head collaring portion to define an outward collaring mouth, wherein the width of the mouth is wider than the thickness of an upper end of the club head.

2. A protective head sheath for a golf club having a club head and a neck sleeve, the sheath being integrally molded of soft elastic material and comprising:

a) a head collaring portion for enclosing a club head and a sleeve collaring portion for enclosing a neck sleeve of a golf club;

b) the head collaring portion being in the shape of a club head and including a lower end, a first outer face having a plurality of transverse stripes formed thereon, a second outer face having a recessed concave portion formed therein and a lower end; and c) the sleeve collaring portion being in the shape of a long pipe and including a downward facing opening, an elastomer portion disposed adjacent the opening, an insertion space having an inner diameter corresponding to the neck sleeve, an entrance extending along a side of the insertion space, a pair of guide strips extending outwardly from opposite sides of the entrance and from a lower end of the sleeve collaring portion up to the lower end of the head collaring portion to define an outward collaring mouth.

* * * * *